US009841240B2

(12) United States Patent
Zhang et al.

(10) Patent No.: US 9,841,240 B2
(45) Date of Patent: Dec. 12, 2017

(54) HEAT EXCHANGER

(71) Applicant: Zhenhai Petrochemical Jianan Engineering Co., Ltd., Ningbo (CN)

(72) Inventors: Xian'an Zhang, Ningbo (CN); Jianliang Wang, Ningbo (CN); Xingmiao Hu, Ningbo (CN); Lijiang Liu, Ningbo (CN); Junjie Li, Ningbo (CN)

(73) Assignee: ZHENHAI PETROCHEMICAL JIANAN ENGINEERING CO., LTD., Zhejiang (CN)

( * ) Notice: Subject to any disclaimer, the term of this patent is extended or adjusted under 35 U.S.C. 154(b) by 427 days.

(21) Appl. No.: 14/394,935

(22) PCT Filed: Mar. 18, 2013

(86) PCT No.: PCT/CN2013/000306

§ 371 (c)(1),
(2) Date: Oct. 16, 2014

(87) PCT Pub. No.: WO2013/139172

PCT Pub. Date: Sep. 26, 2013

(65) Prior Publication Data

US 2015/0198373 A1 Jul. 16, 2015

(30) Foreign Application Priority Data

Mar. 19, 2012 (CN) ..... 2012 1 0072963

(51) Int. Cl.
*F28D 7/10* (2006.01)
*F28F 9/02* (2006.01)
(Continued)

(52) U.S. Cl.
CPC ..... *F28D 7/10* (2013.01); *F28D 7/005* (2013.01); *F28F 9/02* (2013.01); *F28D 7/16* (2013.01); *F28F 2009/029* (2013.01)

(58) Field of Classification Search
CPC ..... F28D 7/16; F28D 7/1615; F28D 7/163; F28D 7/10; F28D 7/005; F28D 7/1684;
(Continued)

(56) References Cited

U.S. PATENT DOCUMENTS 2,693,942 A * 11/1954 Guala ..... F28F 9/22 165/159
3,118,497 A * 1/1964 Olson ..... F28F 9/00 165/157

(Continued)

*Primary Examiner* — Jianying Atkisson
*Assistant Examiner* — Raheena R Malik
(74) *Attorney, Agent, or Firm* — Myron Greenspan Lackenbach Siegel LLP

(57) ABSTRACT

A heat exchange, which includes a casing having a cylinder; two connectors respectively attached to one end of the cylinder through the small opening; two convex heads respectively connected through the opening end to the large opening of a connector; a core disposed inside the casing; and two heat transfer medium passages. In this way, the space at the ends of the casing of the heat exchanger may be enlarged, thereby providing a space large enough to accommodate the construction personal and better working environment for two-side welding and future maintenance and wider selection range of material of the casing of the heat exchanger; a buffer area is provided for the flow of the heat transfer medium, and the auxiliary like baffles may be mounted inside the convex heads as required to further improve the heat exchange efficiency and reduce the cost.

2 Claims, 4 Drawing Sheets

(51) Int. Cl.
*F28D 7/00* (2006.01)
*F28D 7/16* (2006.01)

(58) Field of Classification Search
CPC .. F28F 9/22; F28F 9/026; F28F 9/0263; F28F 9/0268; F28F 2009/029
USPC ..... 165/154, 157, 158
See application file for complete search history.

(56) References Cited

U.S. PATENT DOCUMENTS 3,336,974 A * 8/1967 Bernstein ..... F22B 1/063 165/158
3,443,548 A * 5/1969 Rich ..... F22B 1/1884 122/32
3,610,330 A * 10/1971 Nasser ..... F28D 7/16 165/158
3,651,789 A * 3/1972 Giardina ..... F22B 1/063 122/32
3,812,907 A * 5/1974 Linning ..... F28F 9/0219 165/134.1
4,249,593 A * 2/1981 Bieberbach ..... F22B 1/066 165/158
4,497,363 A * 2/1985 Heronemus ..... F28D 9/0006 165/134.1
8,101,118 B2 * 1/2012 Jin-No ..... C22B 3/02 165/168

* cited by examiner

HEAT EXCHANGER

RELATED APPLICATIONS

This application is a national phase entrance of and claims benefit to PCT Application for a heat exchanger, PCT/CN2013/000306, filed on Mar. 18, 2013, which claims benefit to Chinese Patent Application 201210072963.3, filed on Mar. 19, 2012. The specifications of both applications are incorporated herein by this reference.

FIELD OF THE INVENTION

The present invention relates to a heat exchanger, in particular to a heat exchanger with non-detachable casing and core, which is applicable to high-temperature high-pressure hydrogenation devices, hydrocracking and hydrofining devices, and chemical refining equipments for reforming and aromatic hydrocarbons.

DESCRIPTION OF THE PRIOR ART

As common heat exchange equipment, as shown in FIG. 4, a heat exchanger includes a core 6' and a casing, which may be in detachable connection with each other or designed into a non-detachable structure as required. Each end of the casing of a non-detachable heat exchanger generally includes a cylinder 1' and two convex heads 2' (spherical heads or elliptical heads) located at the two ends of the cylinder 1'; a larger port of each of the convex heads 2' is designed to have a same diameter as that of an opening of the cylinder 1', as shown in FIG. 4, while a tube sheet 5' is provided on a smaller port of each convex head 2' to support one end of the core 6'; and a channel 7' is welded on the outer side of the tube sheet 5' to serve as a tube side passage 8'. A heat exchanger with such a structure, although may achieve the heat exchange function, has the following disadvantages. First, the smaller port of each convex head 2' is needed to provide with a tube sheet 5', so that the convex head 2' may not have a too small caliber. That is, the caliber of the smaller port of the convex head 2' is relatively approximate to that of the larger port. As a result, the axial dimension L of the convex head 2' can not be too large. In this case, the heat transfer medium passage 3' can be formed only on the cylinder 1'. Consequently, when the heat transfer medium enters the casing, on one hand, a dead area is likely to form at the convex head 2', and on the other hand, bias flow of the heat transfer medium, non-uniform flow resistance and inconsistent flow velocity are likely to occur in an effective heat exchange area of the casing, directly resulting in non-uniform heat exchange, decreased efficiency of the heat exchanger and increased pressure drop. Therefore, in order to meet the requirements of subsequent processes on the material flow temperature, generally, an auxiliary device such as a heating furnace is additionally provided on the down stream of the heat exchanger, so as to further raise the temperature of the material flow. Apparently, the use of such a heat exchanger will inevitably causes the whole system huge, and also increases the initial investment cost and the running cost in the future. Second, due to the limited space at the ends of the heat exchanger, auxiliary devices such as flow guide plates and check rings can not be additionally provided in this space, that is to say, the flow form of the casing side medium can not be changed, so that the heat exchange efficiency of the heat exchanger can not be improved effectively. Third, particularly, with a heat exchanger with such end structure, the welding between the cylinder 1' and the convex heads 2' can be performed on only one side because there is no space large enough to accommodate construction personnel at the ports of the casing, influencing the selection of material for the heat exchanger. For example, in the case that the casing is made of clad steel plate material and a surfacing structure, or, in the case that the material of the casing is selected from some kinds of chrome-molybdenum steel which are infeasible for one-side welding, it is difficult to manufacture a heat exchanger due to this conventional structure, thereby seriously influencing the design development and extensive application of the heat exchanger. Fourth, at the end of welding, the testers are still unable to access the ends of the casing to carry out inspection and nondestructive testing. At the end of welding, heat treatment, if required by the welding part, can be carried out by external heating only. Furthermore, it is quite difficult to take protective measures against sensitization of the stainless steel core during the heat treatment. As such, during the future maintenance of the equipment, the maintenance personnel are still unable to access the casing to do maintenance, so maintenance in the future is also quite inconvenient.

SUMMARY OF THE INVENTION

It is an object of the present invention to provide a heat exchanger with the advantages of convenient construction and maintenance, improved flow condition of the heat transfer medium, and extended range of material selection of the heat exchanger.

For achieving the above stated object, a heat exchange comprises: a casing having a cylinder with two ends; two connectors, each connector having a large opening and a small opening, each connector being attached to one end of the cylinder through the small opening; two convex heads, each convex head having an opening end and a tube sheet opposing to the opening end, each convex head being connected through the opening end to the large opening of a connector, each convex head having an internal space which can hold at least an adult; a core with two ends disposed inside the casing, each end of the core supported by the tube sheet on each convex head; and two heat transfer medium passages, one heat transfer medium passage being formed on one convex head; wherein, each connector comprises an annular body with an internal circular edge and an external circular edge which are extended reversely along axial direction of the annular body to form a first circular extension with a first thickness and to form a second circular extension with a second thickness, the large opening is formed in the first circular extension, the small opening is formed in the second circular extension, each annular body has a thickness greater than the first thickness and the second thickness; rectangular corner is respectively formed on the internal circular edge and the external circular edge of each annular body.

Preferably, the large opening of each connector has an external surface for matching a peripheral surface of each convex head, thus enabling the heat transfer medium to flow more smoothly.

Preferably, the casing can be made of clad steel plate and some kinds of chrome-molybdenum steel which are feasible for two-side welding from both inside and outside of the casing.

Compared with the prior art, in the present invention, owing to additionally providing the convex heads, the opening end of each convex head is enlarged as required, so that the axial dimension of each convex head can be increased under the same condition. In this way, the space at the ends of the casing of the heat exchanger may be enlarged, thereby providing a space large enough to accommodate the construction personnel and test personnel to carry out welding and testing operations therein. Therefore, such improvement creates conditions for two-side welding, so that the casing can be made of clad steel plate material or adopts build-up technology, and the material of the casing may be selected from some kinds of chrome-molybdenum steel which are infeasible for one-side welding. That is to say, the selection range of the material of the casing of the heat exchanger becomes wider and the design and manufacture of the equipment becomes more reliable, thereby largely extending the application fields of the heat exchanger. Meanwhile, due to larger space and axial distance of the improved ends of the convex heads, the heat transfer medium passages may be formed on the convex heads. In this way, on one hand, a buffer area is provided for the flow of the heat transfer medium, so that the heat transfer medium passages flows more smoothly, multiphase medium distribution is achieved along the cross-section of the casing, the pressure field and the velocity field become more uniform, the heat exchange efficiency of the heat exchanger is improved significantly, and the pressure drop of the heat transfer medium passages is reduced; on the other hand, baffles and check rings may be mounted inside the convex heads as required to reduce the impact force of the heat transfer medium passages to the core at inlet; meanwhile, auxiliary devices such as flow guide plates and distribution rings may be arranged to further ensure the sufficient heat exchange of the heat exchange area inside the casing. With the use of the heat exchanger provided by the present invention, the temperature of the material flow when discharged from the outlet may be approximate to the required temperature, thereby omitting the subsequent heating devices such as a heating furnace and reducing the running cost. Therefore, this heat exchanger is worthy of popularization and application in the current high-temperature high-pressure hydrogenation devices, hydrocracking and hydrofining devices, and reforming and chemical refining equipment (for example, with aromatic).

DETAILED DESCRIPTION OF THE PREFERRED EMBODIMENT

To enable a further understanding of the innovative and technological content of the invention herein refer to the detailed description of the invention and the accompanying drawings below:

Embodiment 1

Figure 1:
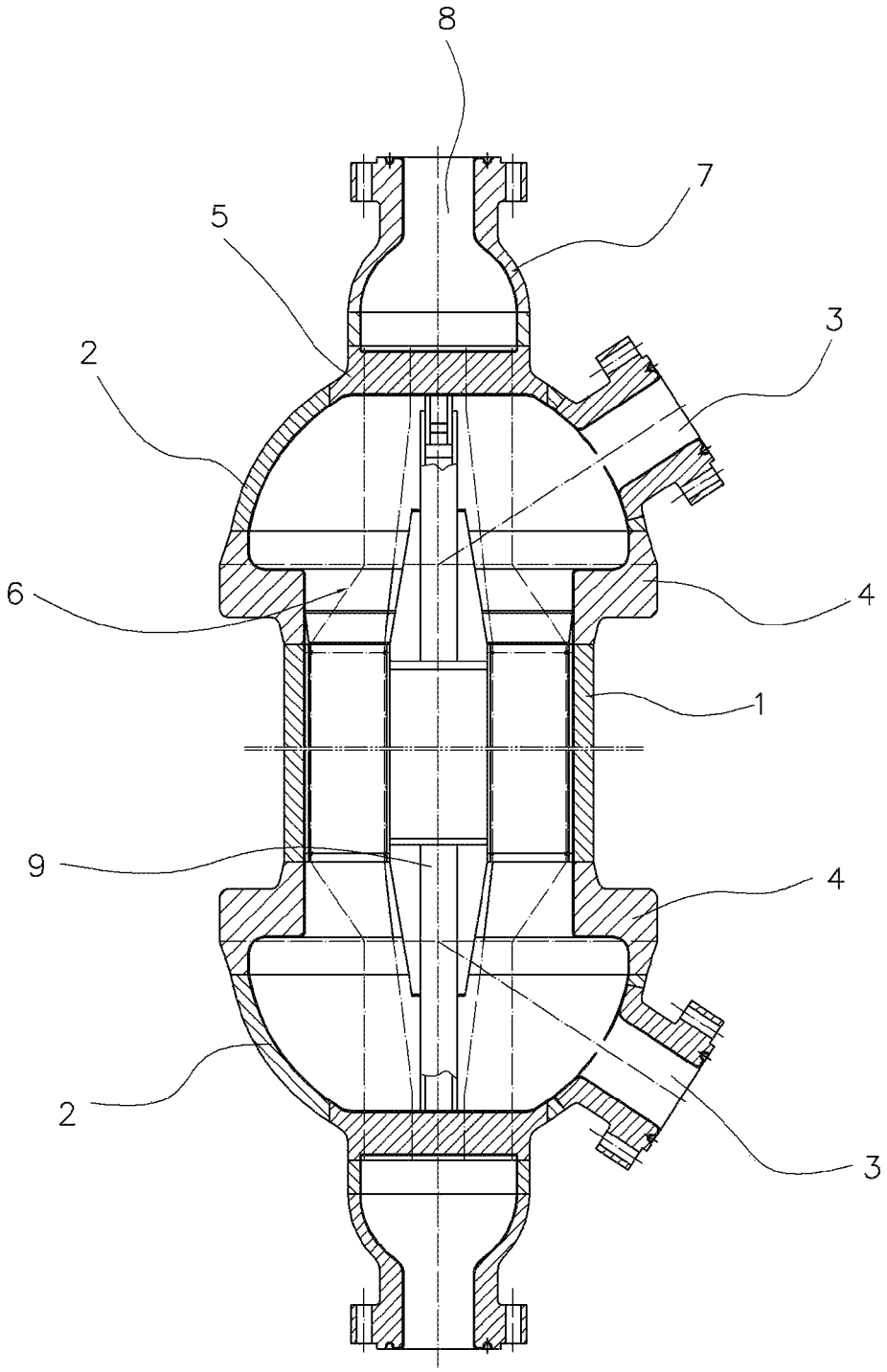
FIG. 1 is a sectional view of a heat exchanger according to the first embodiment of the present invention.
Figure 2:
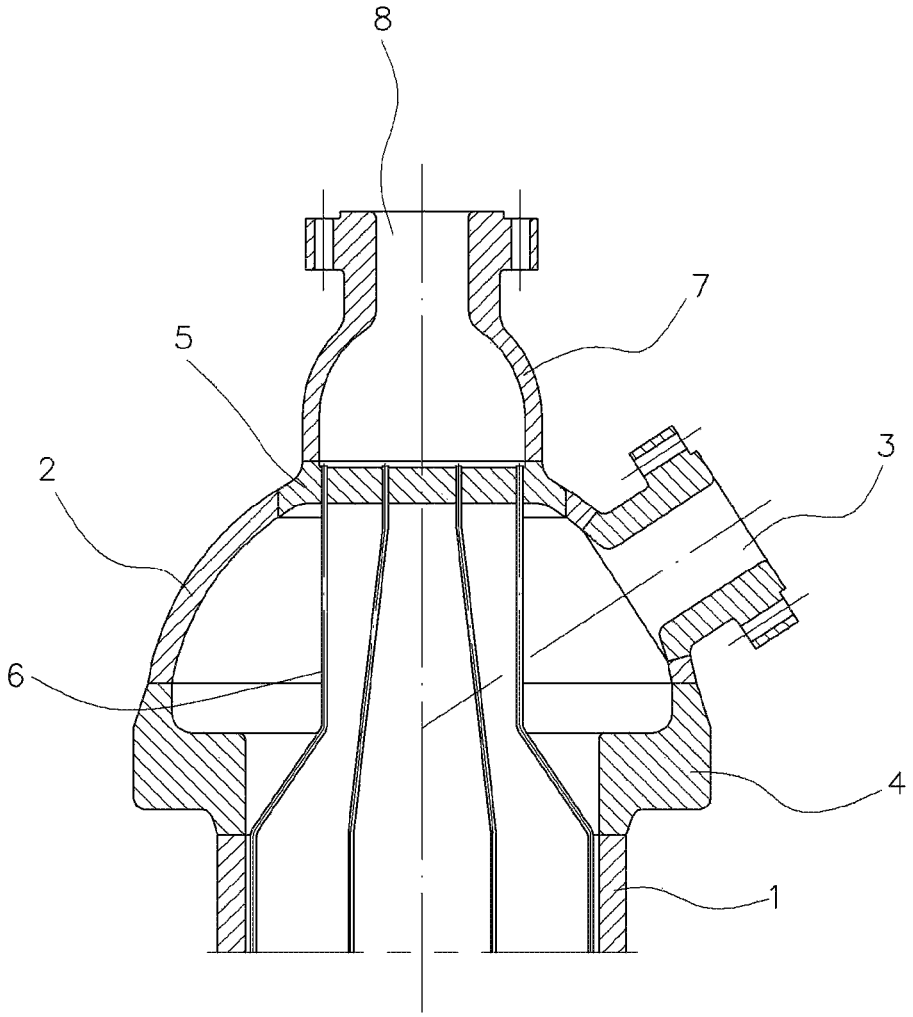
FIG. 2 is a partial sectional view of FIG. 1 (removing a central cylinder).
Figure 3:
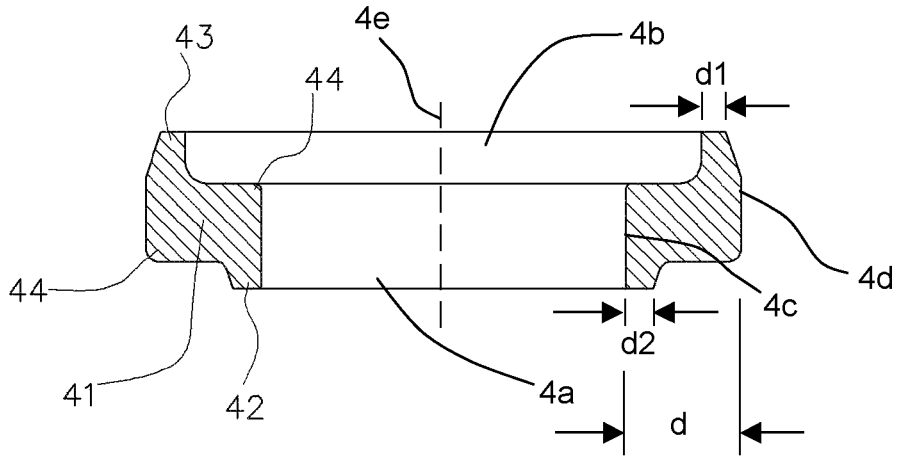
FIG. 3 is a sectional view of a connector of FIG. 2.
Figure 4:
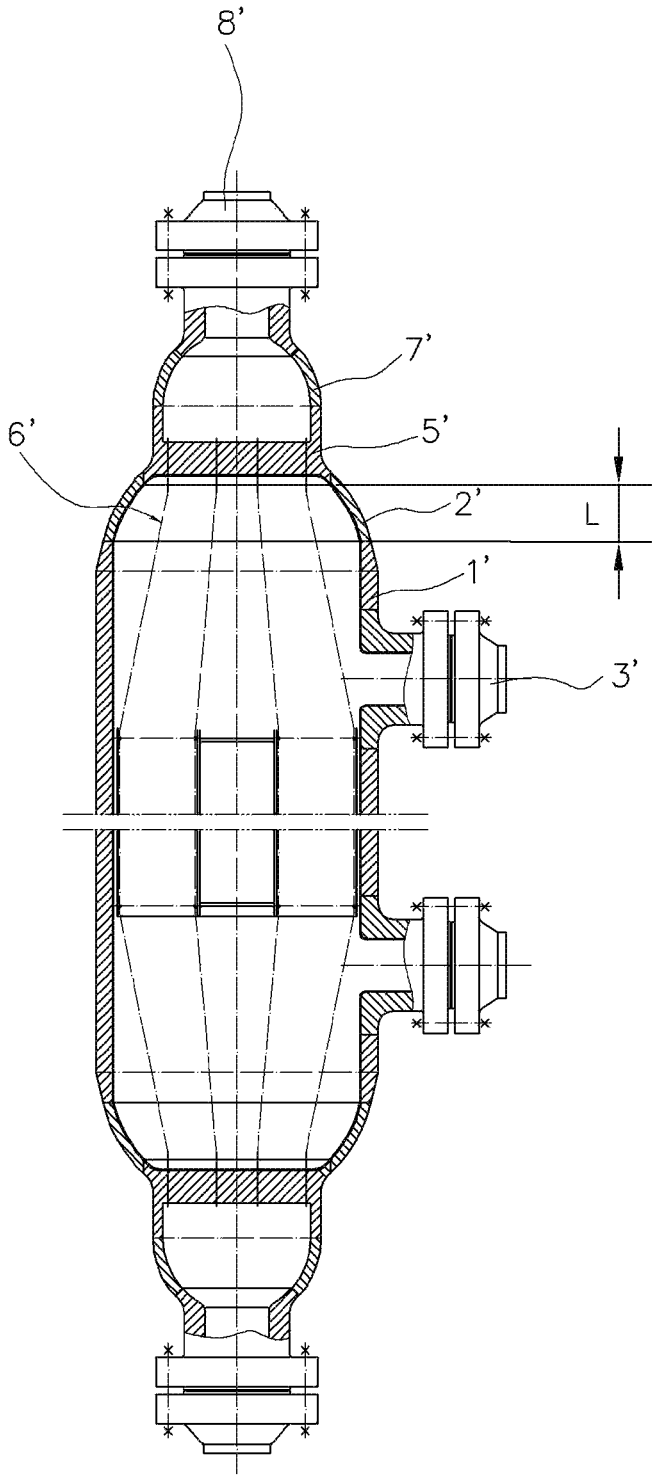
FIG. 4 (Prior Art)
FIG. 4 is a sectional view of the heat exchanger in the prior art.

As shown in FIGS. 1-3, a heat exchanger comprises a casing, a core 6 with two ends disposed inside the casing, each end of the core 6 supported by a tube sheet 5 on each convex head 2, each convex head 2 having an internal space which can hold at least an adult, a central cylinder 9 disposed in the center of the core 6, and two heat transfer medium passages 3 formed on the casing; the casing has a cylinder 1 and two convex heads 2, and the tube sheet 5, the core 6 and the central cylinder 9 are all of conventional configurations; the main improvement is to provide two connectors 4, each connector 4 having two openings with different diameters.

In this embodiment, each connector 4 comprises an annular body 41 with an internal circular edge 4*c* and an external circular edge 4*d* which are extended reversely along axial direction 4*e* of the annular body 41 to form a first circular extension 43 with a first thickness d1 and to form a second circular extension 42 with a second thickness d2; each connector 4 has a large opening 4*b* and a small opening 4*a*, the large opening 4*b* is formed in the first circular extension 43, the small opening 4*a* is formed in the second circular extension 42; each convex head 2 has an opening end, and each convex head 2 is connected through the opening end to the large opening 4*b* of a connector 4, each connector 4 is attached to one end of the cylinder 1 through the small opening 4*a*; rectangular corner 44 is respectively formed on the internal circular edge 4*c* and the external circular edge 4*d* of each annular body 41, each annular body 41 has a thickness d greater than the first thickness d1 and the second thickness d2. Such configuration is applicable to the working condition of high pressure.

Here, the convex heads 2 are designed into semi-spherical, the heat transfer medium passages 3 are respectively formed on one convex head 2, and the large opening 4*b* of each connector 4 has an external surface for matching a peripheral surface of each convex head 2, thus enabling the heat transfer medium to flow more smoothly.

During assembling, the small opening 4*a* of each connector 4 and the cylinder 1, as well as the large opening 4*b* of each connector 4 and each convex head 2, are fixedly butted in turn by means of two-side welding, then each tube sheets 5 is butted and welded to the end, opposing to the opening end, of each convex head 2, and finally each channel 7 is welded on the outer side of each tube sheet 5 to serve as a tube side passage 8.

In this embodiment, the space at the ends of the casing may be enlarged by using the connectors 4, thereby making feasible for two-side welding and future maintenance and wider selection range of material of the casing of the heat exchanger. Meanwhile, the large space at the ends of the casing may be used as a buffer area of the heat transfer medium during the heat exchange of the heat exchanger, thereby optimizing the flow state of the heat transfer medium to improve the heat exchange efficiency. Furthermore, in such a structure, auxiliary devices such as flow guide plates and check rings may be additionally provided as required, to further improve the heat exchange efficiency. Moreover, as there is a large enough space at the ends of the casing, when the welding part requires heat treatment, heating modules may be placed on the inner and outer walls of the ends of casing for bilaterally heating, and insulating measures may be taken for the ends of the core 6 to avoid the sensitization of the stainless steel heat exchange tubes.

The invention claimed is:

1. A heat exchanger comprising:

a casing defining an axis and having a cylinder (1) with two ends axially displaced along said axis;

two annular connectors (4), each connector (4) having an annular body (41) defining a radially outer portion and a radially inner portion and a large opening (4*b*) and a small opening (4*a*), each connector (4) being attached to one end of the cylinder (1) through an associated small opening (4*a*), a first annular extension (43) projecting axially from and integrally formed with said radially outer portion in the direction of said large opening (4*b*) and a second annular extension (42) projecting axially from and integrally formed with said radially inner portion in the direction of said small opening (4*a*);

two convex heads (2), each convex head (2) having an opening end and a tube plate (5) axially opposing said opening end, each convex head (2) being connected through said opening end to said large opening (4*b*) of an associated connector (4);

a core (6) with two ends axially disposed inside said casing, each end of said core (6) being supported by an associated tube plate (5) on each convex head (2); and two heat transfer medium passages (3), one heat transfer medium passage (3) being formed on each convex head (2);

wherein, said first annular extension (43) has a first radial thickness (d1) and said second annular extension has a second radial thickness (d2), said large opening (4*b*) is defined by said first annular extension (43) and said small opening (4*a*) is defined by said second annular extension (42), each annular body (41) having a radial thickness (d) greater than said first thickness (d1) and said second thickness (d2), substantially rectangular corners (44) being formed on said annular body (41) at axially opposite ends of each of said integrally formed first and second annular extensions (42, 43) of said annular body (41).

2. The heat exchanger of claim 1, wherein the casing is made of one of clad steel plate and chrome-molybdenum steel for two-side welding from both inside and outside of the casing.

* * * * *